US006269912B1

(12) United States Patent
Kim

(10) Patent No.: US 6,269,912 B1
(45) Date of Patent: Aug. 7, 2001

(54) ELEVATOR SYSTEM FOR CONTROLLING RESPONSE TO CALL

(75) Inventor: Jee Hoon Kim, Seoul (KR)

(73) Assignee: LG Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 09/370,980

(22) Filed: Aug. 10, 1999

(30) Foreign Application Priority Data

Aug. 10, 1998 (KR) ..... 98/32455

(51) Int. Cl.[7] ..... B66B 1/16
(52) U.S. Cl. ..... 187/380; 187/391
(58) Field of Search ..... 127/380, 382, 127/387, 391, 392, 393

(56) References Cited

U.S. PATENT DOCUMENTS 3,630,318 * 12/1971 Stichweh et al. ..... 187/29 R
3,782,504 * 1/1974 Billmaier et al. ..... 187/29 R
3,973,648 * 8/1976 Hummert et al. ..... 187/29 R
4,013,993 * 3/1977 Mandel et al. ..... 340/19 R
4,958,707 9/1990 Yoneda et al. .

* cited by examiner

*Primary Examiner*—Jonathan Salata
(74) *Attorney, Agent, or Firm*—Birch, Stewart, Kolasch & Birch, LLP

(57) ABSTRACT

In accordance with an elevator system for controlling a response to a call of the present invention, each of sub-controllers includes a unit of storing the information regarding service ability to a hall call, and a unit of determining service ability based on the information stored in the unit when the call is generated from the hall, regardless of a call response signal from a main controller. As a result, the determination and display of service ability to the hall call can be rapidly exactly performed. In addition, the main controller includes a unit of checking and determining abnormality of the sub-controllers, and a unit of storing an identifier of the abnormal sub-controller. Since the data is not transmitted to the abnormal sub-controller, a data transmission amount may be decreased. Also, during the repair or replacement work of the abnormal sub-controller, an identifier thereof can be rapidly confirmed. Moreover, the sub-controller includes a unit of checking and determining abnormality of the main controller. When the main controller is abnormally operated, a response lamp is turned off. As a result, the passengers are informed of that the elevator car is not able to provide the service, and thus do not unnecessarily wait for the elevator car at the hall.

6 Claims, 9 Drawing Sheets

| ID | Data | ID | Data | ID | Data | CAR POSITION Data |
|---|---|---|---|---|---|---|

| ID | Data |
|---|---|

ELEVATOR SYSTEM FOR CONTROLLING RESPONSE TO CALL

BACKGROUND OF THE INVENTION

1. Field of the Invention

The present invention relates to an elevator system for controlling a response to a call, and in particular to an elevator system for controlling a response to a call wherein a sub-controller, namely a hall controller determines service ability of an elevator car responding to a call, and a main controller, namely an elevator controller and a plurality of sub-controllers are periodically examined, which results in improved reliability and rapidity of the call response.

2. Description of the Background Art

FIG. 1 is a block diagram illustrating a conventional elevator system for controlling the response of an elevator car E moving between floors in a building to a call. The conventional elevator system for controlling the response to the call will now be described with reference to FIG. 1. A main controller MC is connected to a plurality of sub-controllers SC1–SCn disposed on each floor in a building via a serial communication line SL. An upper direction call button (hereinafter, 'UP button') UB, an upper direction response lamp UL, and a car position indicator CP1 are connected to the sub-controller SC1 provided on a lowest floor of a building through each signal line. A lower direction call button (hereinafter, 'DOWN button') DB, a lower direction response lamp DL, and a car position indicator CPn are connected to the sub-controller SCn provided on a highest floor of the building via each signal line. The UP button UB, the DOWN button DB, the upper direction response lamp UL, the lower direction response lamp DL and the car position indicator CP2–CPn–1 are connected to the sub-controllers SC2–SCn–1 positioned on the floors between the highest and lowest floors.

The main controller MC is a controller installed in a machinery room which is generally provided on the highest floor, and determines service ability of an elevator car in response to an upper direction call or a lower direction call from a passenger at a hall of a floor of the building. When the service can be provided, the main controller MC transmits a direction signal to the sub-controllers SC1–SCn turning on the response lamp UL or DL in a corresponding direction.

In case a car approaches a floor where the call is generated, the main controller MC transmits a instruction signal representing flickering the response lamp UL or DL to the sub-controllers SC1–SCn. After the passengers get in the elevator car, the main controller MC transmits an instruction signal representing turning off the response lamp UL or DL to the sub-controllers SC1–SCn. In addition, the main controller MC transmits to the sub-controllers SC1–SCn a floor information signal of indicating a floor where the elevator car is currently positioned.

The plurality of sub-controllers SC1–SCn are installed on each floor of the building. As the call button UB or DB is pushed, the sub-controllers SC1–SCn generate an elevator call signal, and transmit it to the main controller MC. In addition, each sub-controller SC1–SCn receives the ON instruction signal, the OFF instruction signal, the response lamp flickering instruction signal, and the car position information signal from the main controller MC, and controls an operation of the corresponding response lamp UL or DL and car position indicator CP1–CPn in accordance with the received instruction signals.

Three examples of the conventional technique of controlling the response to the call in the elevator system will now be explained.

A first example was described above. Here, the response lamp is turned on when the ON instruction signal of the response lamp is received from the main controller MC. However, as the plurality of sub-controllers are connected to the common serial communication line SL, if a communication is simultaneously generated, the ON operation may be delayed due to a communication delay.

A second example is that the sub-controllers SC1–SCn turn on the response lamp as soon as the call is generated. In this method, when the elevator car is not able to provide a service due to any abnormality of the serial communication line SL, the main controller MC, and the other components connected to the main controller MC, such as a speed controller, a position controller, a brake, various switches and safety devices, the passengers wait without receiving a service, thereby causing inconvenience.

As a third example, a timer is provided to the sub-controllers SC1–SCn. When the call is generated, the sub-controllers SC1–SCn directly turn on the response lamp. In case the ON instruction signal of the response lamp is not received from the main controller MC until a predetermined time set in the timer lapses, the response lamp is turned off. However, the passengers spend much time while the response lamp is turned on and off, and as a result, the service cannot be provided, thereby causing inconvenience to the passengers.

SUMMARY OF THE INVENTION

Accordingly, it is a primary object of the present invention to provide an elevator system for controlling a response to a call which can turn on a response lamp at once, when a service can be provided in response to an elevator call from a passenger.

It is another object of the present invention to provide an elevator system for controlling a response to a call which can improve service reliability according to an operation of turning on a response lamp.

In order to achieve the above-described objects of the present invention, there is provided an elevator system for controlling a response to a call, including: a call button calling an elevator car; a response lamp responding to a call by the call button, and indicating that the elevator car is able to provide a service; a plurality of sub-controllers connected to the call button and the response lamp, determining service ability of the elevator car responding to a call when the call is generated by the call button, and controlling an ON/OFF state of the response lamp according to service ability of the elevator car; a main controller providing to the sub-controllers varied information regarding service ability; and a serial communication line providing a communication line between the plurality of sub-controllers and the main controller.

The above-described and other objects, the constitution and the operation of the present invention will be better understood by reading preferred embodiments of the present invention.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

Figure 1:
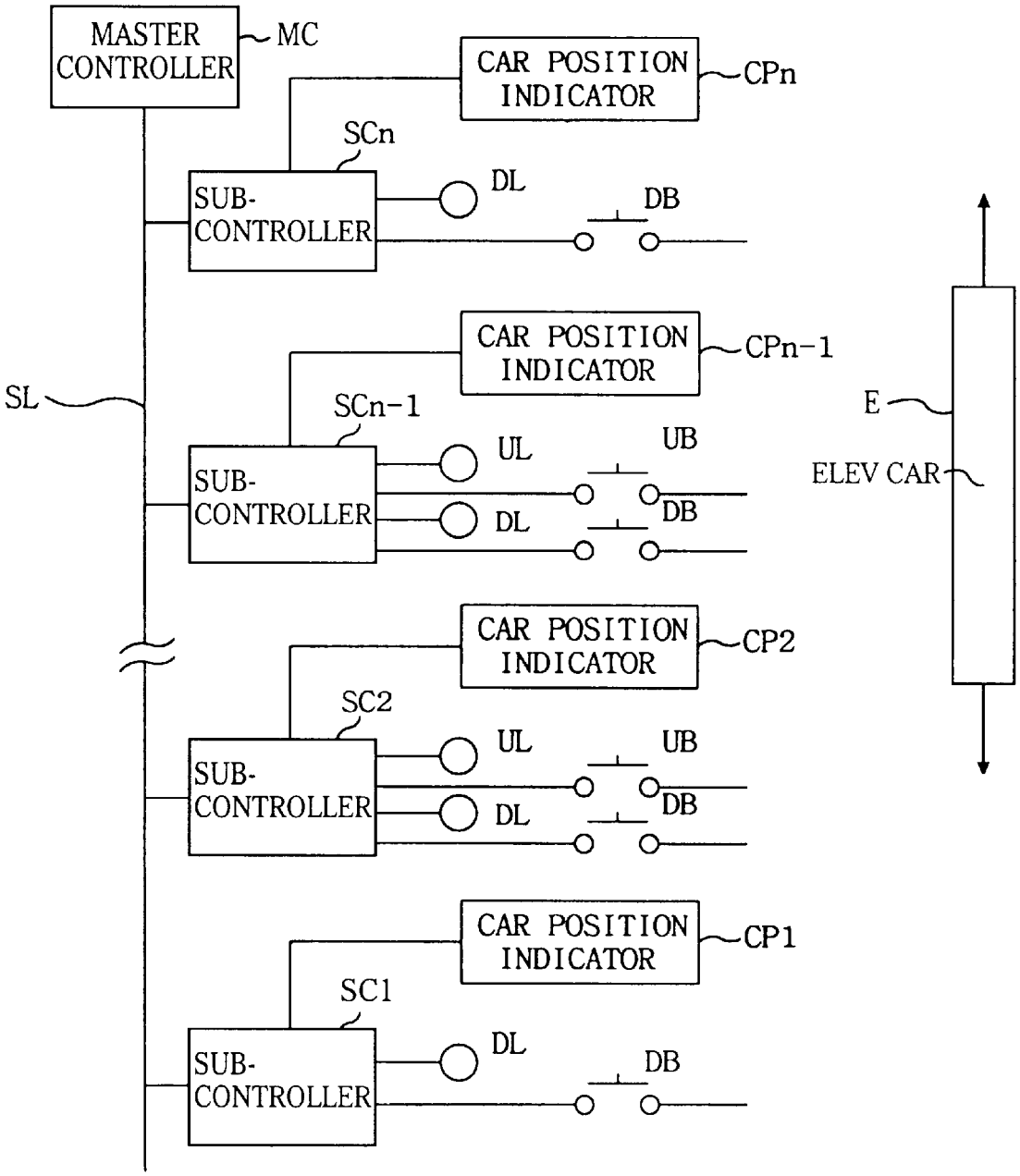
FIG. 1 CONVENTIONAL ART
FIG. 1 is a block diagram illustrating a conventional elevator system for controlling a response to a call.

An elevator system for controlling a response to a call in accordance with the present invention is identical to the conventional one as depicted in FIG. 1, except for a main controller and sub-controllers.

Accordingly, an explanation of a serial communication line, a response lamp, a call button and a car position indicator is omitted, and the identical components to those as shown in FIG. 1 are provided with the same reference numerals.

Figure 2:
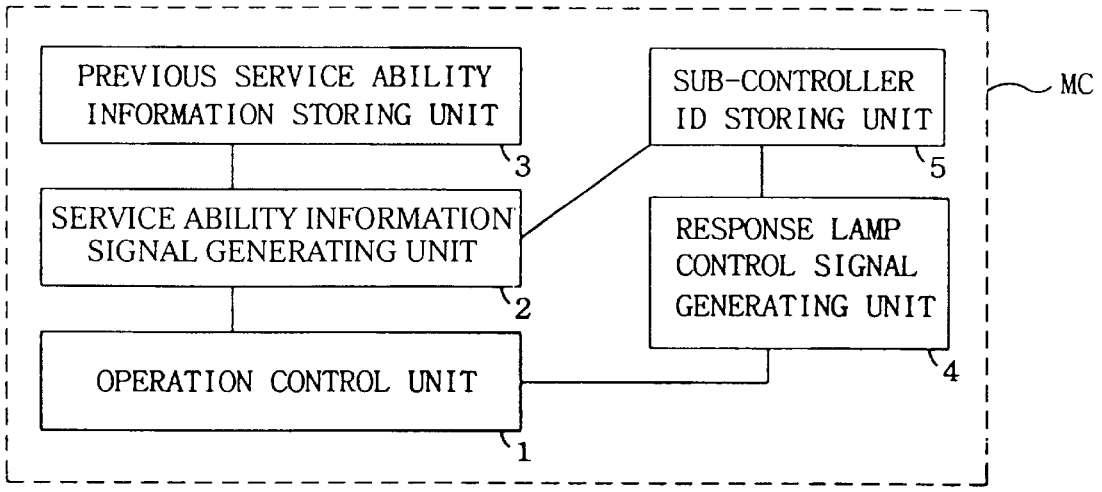
FIG. 2 is a block diagram illustrating a main controller in accordance with a first embodiment of the present invention.

First, the operation of the main controller in accordance with a first embodiment of the present invention will now be described with reference to FIG. 2. FIG. 2 is a detailed block diagram illustrating the main controller in accordance with the first embodiment of the present invention. As shown in FIG. 2, the main controller MC includes an operation control unit 1, a service ability information signal generating unit 2, a previous service ability information storing unit 3, a response lamp control signal generating unit 4, and a sub-controller ID storing unit 5.

The operation control unit 1 responses to an elevator call signal, and outputs to a speed controller (not shown) a direction signal representing an upper or lower direction running to a floor where the call signal is generated. The operation control unit 1 receives position and speed information regarding a currently-operated elevator car from the speed controller, is connected to a position detector (not shown) installed on a hoist way where the elevator car is operated, and receives a position detection signal of the elevator car from the position detector. As a result, the operation control unit 1 can provide an information signal regarding a current positioned floor of the elevator car.

In addition, the operation control unit 1 is directly or indirectly connected to various safety devices, brake devices, and driving devices, control devices and switches which relate to driving and position controlling of hall doors on each floor, and driving devices, control devices, and switches which relate to driving and position controlling of an elevator car door, outputs various direction signals thereto, and receives signals indicating a current state therefrom. Accordingly, since the operation control unit 1 receives state information including an abnormal state of the directly- or indirectly-connected devices, if a call is generated at a hall of a predetermined floor at a predetermined time, the operation control unit 1 can determine service ability of the elevator car, and output an information signal showing a determination result.

The service ability information signal generating unit 2 is connected to the operation control unit 1, periodically receives a signal showing service ability from the operation control unit 2, and compares the information regarding service ability of the received signal with previous service ability information stored in the previous service ability storing unit 3. As a comparison result, when the information stored in the operation control unit 1 is different from the information stored in the previous service ability information storing unit 3, the service ability information signal generating unit 2 generates varied information regarding service ability as a service ability information signal SAS, and transmits it to the sub-controllers SC1–SCn through the serial communication line SL. Here, in order to improve communication reliability, the varied information regarding the service ability is repeatedly transmitted. To the contrary, as a comparison result, in case the information stored in the operation control unit 1 is identical to the information stored in the previous service ability information storing unit 3, the service ability information signal generating unit 2 does not transmit the service ability information signal SAS regarding the service ability. On the other hand, whenever the service ability information is varied, the previous service ability information storing unit 3 renews and stores the service ability information provided by the service ability information signal generating unit 2.

When an elevator call signal is received from the sub-controllers SC1–SCn, the response lamp control signal generating unit 4 generates a response lamp control signal LCS depending on the information signal representing service ability from the operation control unit 1. That is, when the information signal indicating that the elevator car can provide the service is received from the operation control unit 1, the response lamp control signal generating unit 4 generates a response lamp control signal LCS, namely instruction signal representing turning on the response lamp UL or DL. On the other hand, the sub-controller ID storing unit 5 receives and stores each identifier from the sub-controllers SC1–SCn via the serial communication line SL. The response lamp control signal generating unit 4 reads the identifier of the sub-controller from the sub-controller ID storing unit 5, and transmits it together with the response lamp control signal LCS to the sub-controllers SC1–SCn via the serial communication line SL.

When the information signal indicating that the elevator car is not able to provide the service is received from the operation control unit 1, the response lamp control signal generating unit 4 does not generate the response lamp control signal LCS. Accordingly, the response signal to the call signal is not transmitted. In addition, in case the information signal indicating that the elevator car arrives at a floor where the call is generated is received from the operation control unit 1, the response lamp control signal generating unit 4 generates the response lamp control signal LCS having a instruction representing turning off the response lamp UL or DL, and transmits it to the sub-controllers SC1–SCn via the serial communication line SL.

On the other hand, the operation control unit 1 consecutively transmits the current car position information to the sub-controllers SC1–SCn via the serial communication line SL. Here, the car position information is the common information of the sub-controllers SC1–SCn, and thus not provided with an identifier of the specific sub-controller.

Figure 3:
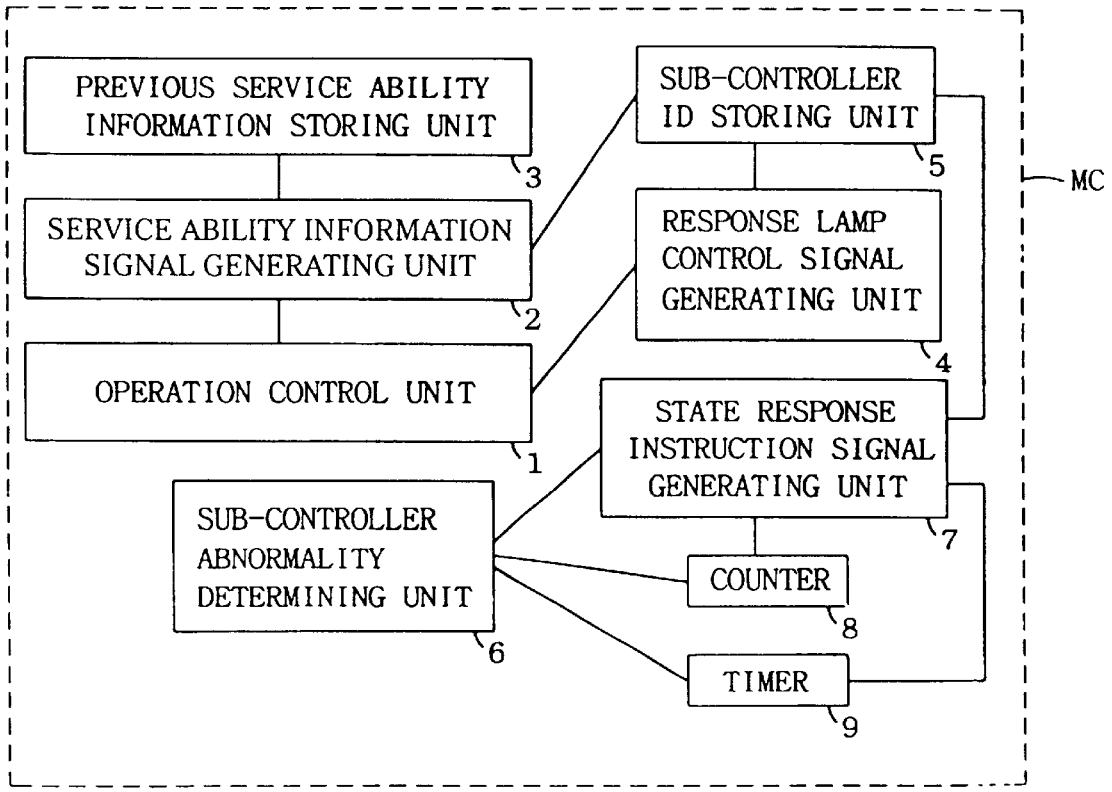
FIG. 3 is a block diagram illustrating a main controller in accordance with a second embodiment of the present invention.

The construction and operation of a main controller in accordance with a second embodiment of the present invention will now be explained with reference to FIG. 3. FIG. 3 is a detailed block diagram illustrating the main controller in accordance with the second embodiment of the present invention. The main controller MC as shown in FIG. 3 further includes units having a function of determining an abnormality of the sub-controllers SC1–SCn, in addition to the main controller MC in accordance with the first embodiment of the present invention, as shown in FIG. 2. That is, the main controller MC as shown in FIG. 3 further includes a sub-controller abnormality determining unit 6, a state response instruction signal generating unit 7, a counter 8 and a timer 9, as compared with the main controller MC as shown in FIG. 2. Therefore, the constitution and the sub-controller abnormality determining operation of the newly-added units will now be described.

First, so as to detect abnormality of the sub-controllers SC1–SCn, the state response instruction signal generating unit 7 generates a state response instruction signal SRIS, reads the identifiers of each sub-controller SC1–SCn from the connected sub-controller ID storing unit 5, and sequentially transmits the identifiers and the state response instruction signal SRIS to the sub-controllers SC1–SCn through the serial communication line SL.

On the other hand, the state response instruction signal generating unit 7 is connected to the counter 8, and the counter 8 receives the state response instruction signal SRIS. Whenever the counter 8 receives the state response instruction signal SRIS, it counts the number. When counting a predetermined number, for example three times, the counter 8 transmits an output signal indicating this counting up to the sub-controller abnormality determining unit 6. Thereafter, when receiving the next state response instruction signal SRIS, the counter 8 resets the number which has been counted.

The state response instruction signal generating unit 7 is connected to the timer 9. Whenever the timer 9 receives the state response instruction signal SRIS from the state response instruction signal generating unit 7, if a predetermined time, for instance 200 ms lapses, the timer 9 outputs an output signal indicating this to the sub-controller abnormality determining unit 6. In case the timer 9 receives the next state response instruction signal SRIS, the timer 9 resets the time which has lapsed.

After the state response instruction signal SRIS is transmitted to a certain sub-controller SC1–SCn, if the state response signal is not received from the corresponding sub-controller SC1–SCn until the output signal from the counter 8 and the output signal from the timer 9 are received, the sub-controller abnormality determining unit 6 determines that the corresponding sub-controller SC1–SCn is abnormal. To the contrary, after the state response instruction signal SRIS is transmitted to a certain sub-controller SC1–SCn, if the state response signal is received from the corresponding sub-controller SC1–SCn before the output signal from the counter 8 and the output signal from the timer 9 are received, the sub-controller abnormality determining unit 6 judges that the corresponding sub-controller SC1–SCn is normal.

The information regarding abnormality of a certain sub-controller SC1–SCn determined by the sub-controller abnormality determining unit 6 makes a repairman rapidly recognize an abnormal sub-controller SC1–SCn during the repair works. It is preferable to store and provide the information upon the demand of the repairman. Accordingly, a main controller having such a function in accordance with a third embodiment of the present invention will now be explained with reference to FIG. 4.

Figure 4:
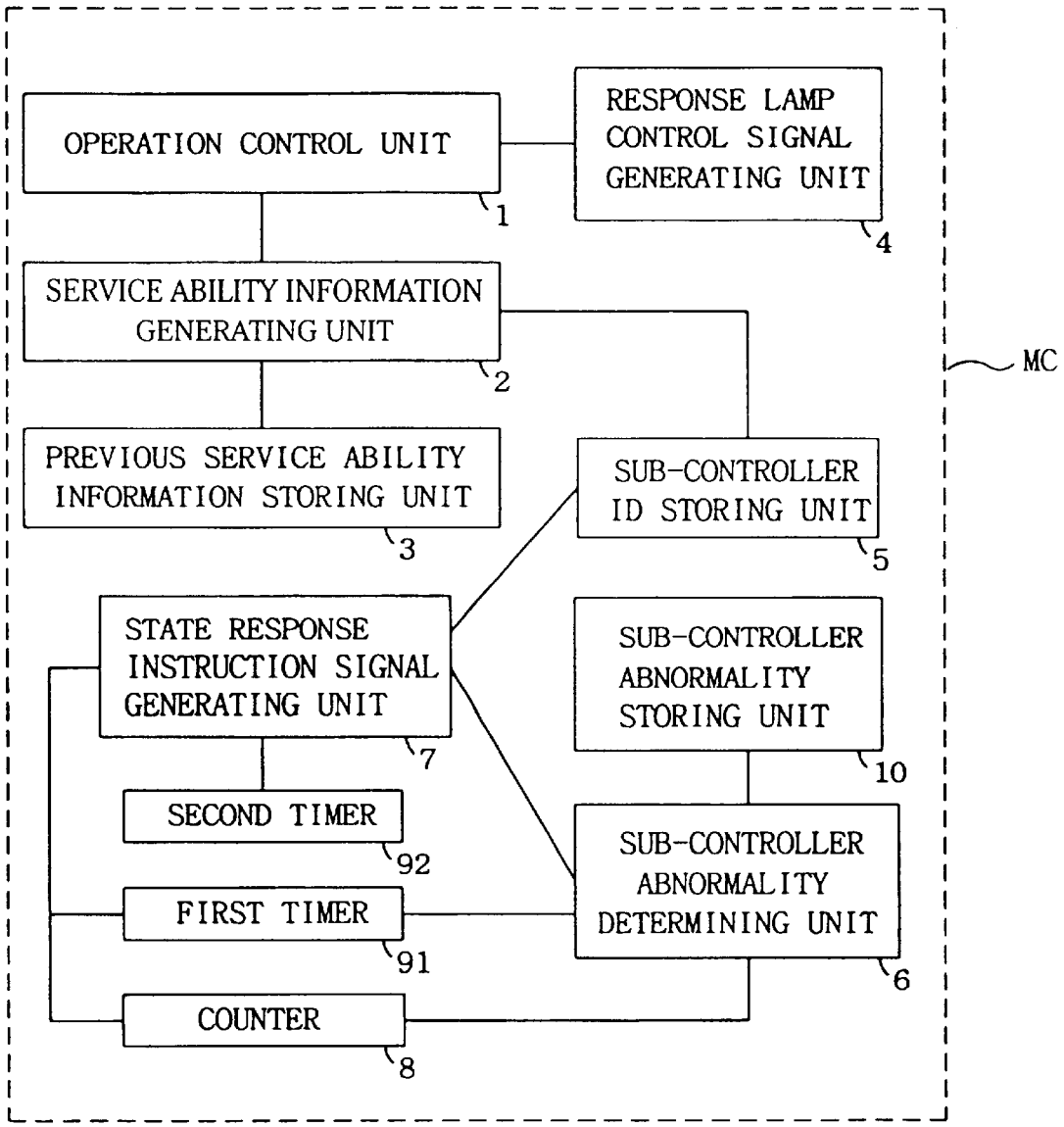
FIG. 4 is a block diagram illustrating a main controller in accordance with a third embodiment of the present invention.

FIG. 4 is a block diagram illustrating the main controller in accordance with the third embodiment of the present invention. The main controller MC as shown in FIG. 4 further includes a second timer 92 providing an output period of the state response instruction signal SRIS, and a sub-controller abnormality storing unit 10 storing an information data regarding abnormality of the sub-controllers SC1–SCn, as compared with the main controller MC as shown in FIG. 3. Thus, in order to avoid redundancy, only the characteristic units will now be explained.

The second timer 92 is connected to the state response instruction signal generating unit 7 in order to provide an output period of the state response instruction signal SRIS, and can set a predetermined time according to the output period of the state response instruction signal SRIS. If the predetermined time lapses, the second timer 92 outputs an output signal indicating this to the state response instruction signal generating unit 7, and resets the time which has lapsed. Accordingly, whenever the state response instruction signal generating unit 7 receives an output signal from the second timer 92, it generates the state response instruction signal SRIS, reads the identifiers of each sub-controller SC1–SCn from the sub-controller ID storing unit 5, and sequentially respectively transmits them to the sub-controllers SC1–SCn via the serial communication line SL.

The sub-controller abnormality storing unit 10 is connected to the sub-controller abnormality determining unit 6. When the sub-controller abnormality determining unit 6 determines that a certain sub-controller is abnormal, the sub-controller abnormality storing unit 10 receives and stores the information indicating abnormality of the sub-controller, together with the identifier thereof.

If a repair worker connects a state indicator and a keyboard to the main controller MC in order to repair or replace the abnormal sub-controller, and demands a display of the abnormal sub-controller, the main controller MC outputs the information indicating abnormality of the sub-controller and the identifier thereof which are stored in the sub-controller abnormality storing unit 10, and displays them on the state indicator.

Figure 5:
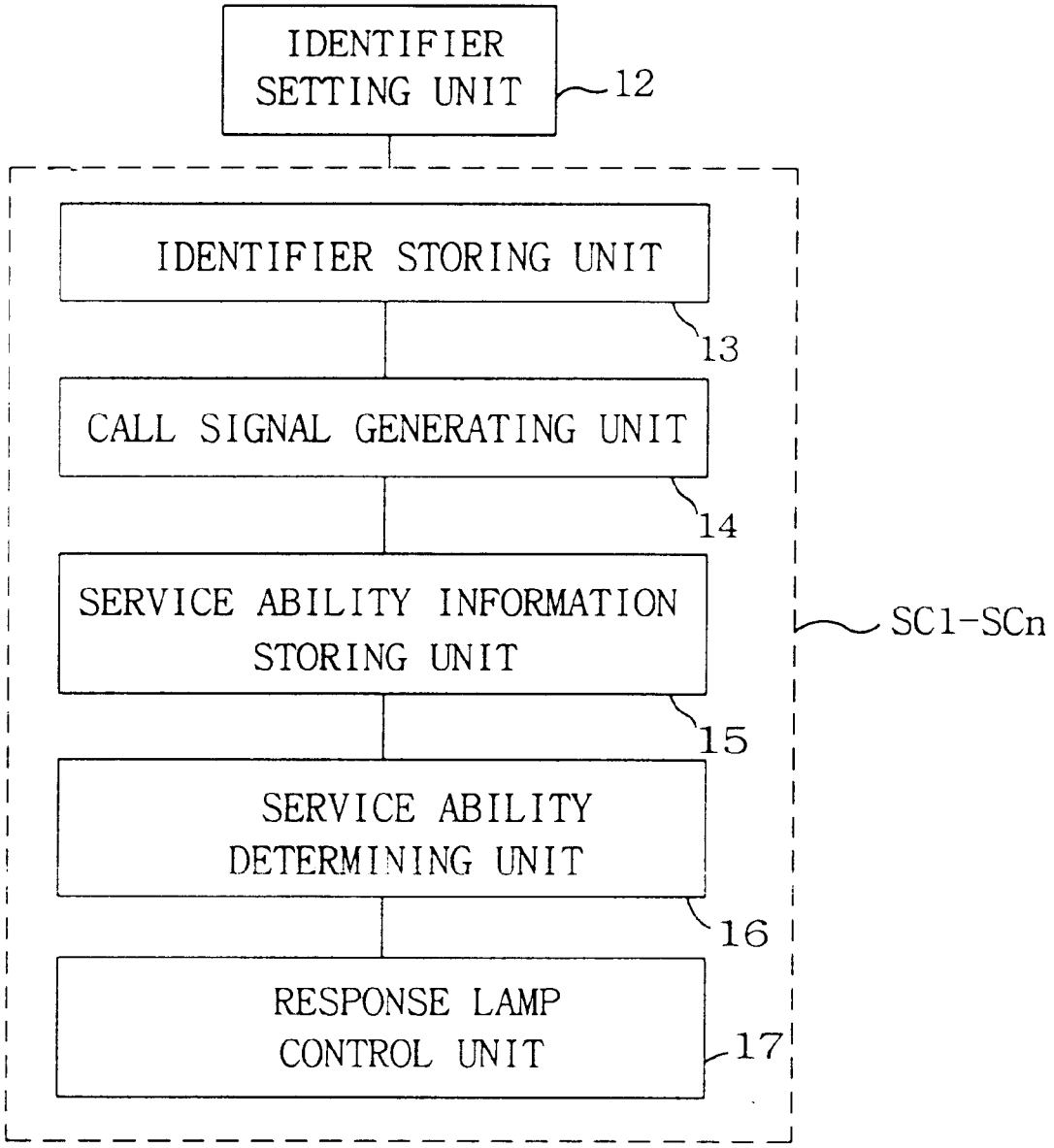
FIG. 5 is a block diagram illustrating sub-controllers in accordance with the first embodiment of the present invention.

The detailed constitution of the sub-controller SC1–SCn in accordance with the first embodiment of the present invention will now be explained with reference to FIG. 5. FIG. 5 is a block diagram illustrating the sub-controllers in accordance with a first embodiment of the present invention.

An identifier setting unit 12 is connected to the sub-controllers SC1–SCn, and sets identifiers thereof. The identifier setting unit 12 may be embodied by connecting in series a plurality of switches connected to a direct voltage Vcc in order to set special binary codes as an identifier for each sub-controller SC1–SCn, and to provide the binary code signals thereto. The sub-controllers SC1–SCn include an identifier storing unit 13, a call signal generating unit 14, a service ability information storing unit 15, a service ability determining unit 16 and a response lamp control unit 17.

The identifier storing unit 13 stores the identifier from the identifier setting unit 12. The call signal generating unit 14 generates a call signal CS when the passenger pushes the call button at the hall, namely the UP button UB or DOWN button DB. The call signal generating unit 14 is connected to the identifier storing unit 13, reads the identifier from the identifier storing unit 13, and transmits it with the call signal CS to the main controller MC through the serial communication line SL.

The service ability information storing unit 15 stores an information data regarding service ability. When receiving the varied service ability information signal SAS from the main controller MC, the service ability determining unit 16 stores the information data regarding service ability indicated by the service ability information signal SAS in the service ability information storing unit 15, thereby updating the information data regarding service ability previously stored in the service ability information storing unit 15. In addition, when the passenger pushes the UP button UB or DOWN button DB, the service ability determining unit 16 determines service ability depending upon the information data regarding service ability stored in the service ability information storing unit 15. That is, in the case that the information data regarding service ability stored in the service ability information storing unit 15 is an information data indicating that the service can be provided, the service ability determining unit 16 outputs a instruction signal of turning on the response lamp UL or DL to the response lamp control unit 17. When the information data regarding service ability stored in the service ability information storing unit 15 is an information data indicating that the service cannot be provided, the service ability determining unit 16 outputs a instruction signal of turning off the response lamp UL or DL to the response lamp control unit 17.

The response lamp control unit 17 turns on or off the response lamp UL or DL according to the instruction signal from the service ability determining unit 16. In addition, when the elevator car arrives at the hall where the call is generated, the main controller MC transmits the instruction signal of turning off the response lamp UL or DL to the sub-controllers SC1–SCn. The response lamp control unit 17 responds to the OFF instruction signal from the main controller MC, and thus turns off the response lamp UL or DL. When receiving the instruction signal of turning on the response lamp UL or DL from at least one of the service ability determining unit 16 and the response lamp control signal generating unit 4 of the main controller MC, the response lamp control unit 17 turns on the response lamp UL or DL.

Figure 6:
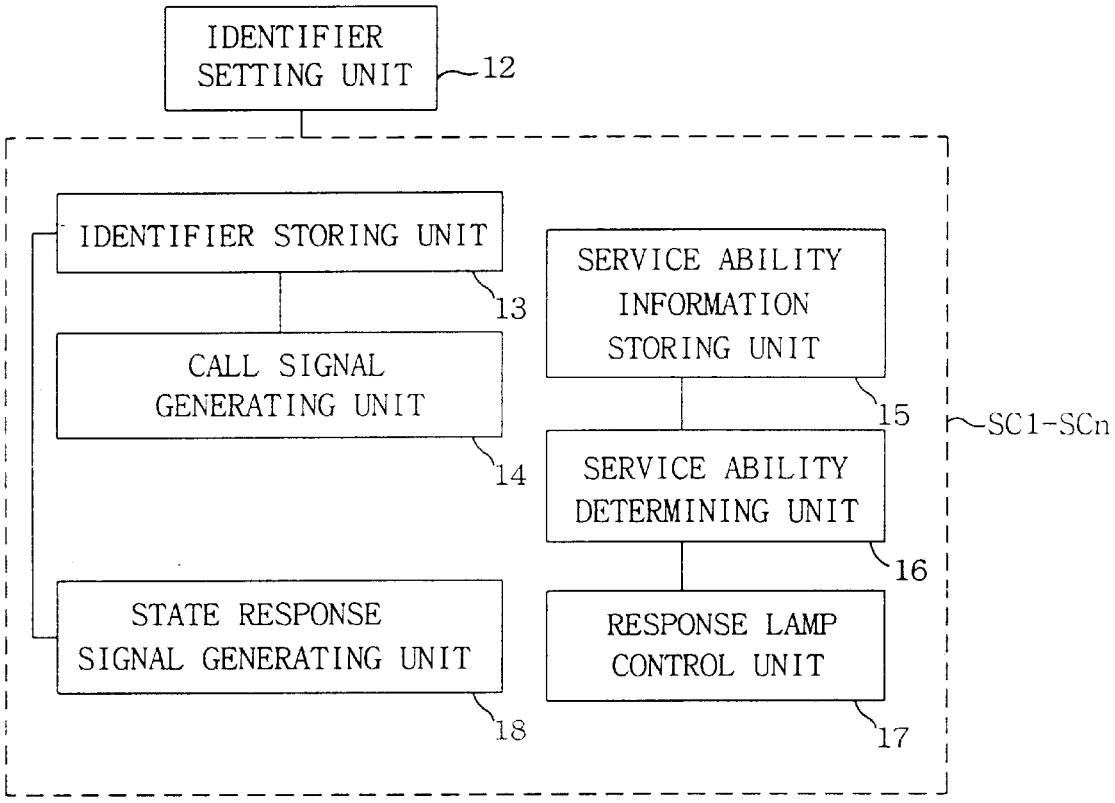
FIG. 6 is a block diagram illustrating sub-controllers in accordance with the second embodiment of the present invention.

FIG. 6 is a block diagram illustrating the sub-controllers in accordance with a second embodiment of the present invention. The sub-controllers SC1–SCn as shown in FIG. 6 further include a state response signal generating unit 18 providing a state response signal thereof in order to correspond to the main controller MC as shown in FIGS. 3 and 4. The other components are identical in constitution and operation to the embodiment as shown in FIG. 5. The state response signal generating unit 18 as depicted in FIG. 6 responses to a state response instruction signal SRIS from the state response instruction signal generating unit 7 of the main controller MC as shown in FIGS. 3 and 4, and transmits the state response signal SRS indicating that the corresponding sub-controller SC1–SCn is normal to the main controller MC via the serial communication line SL, together with the identifier from the identifier storing unit 13.

Figure 7:
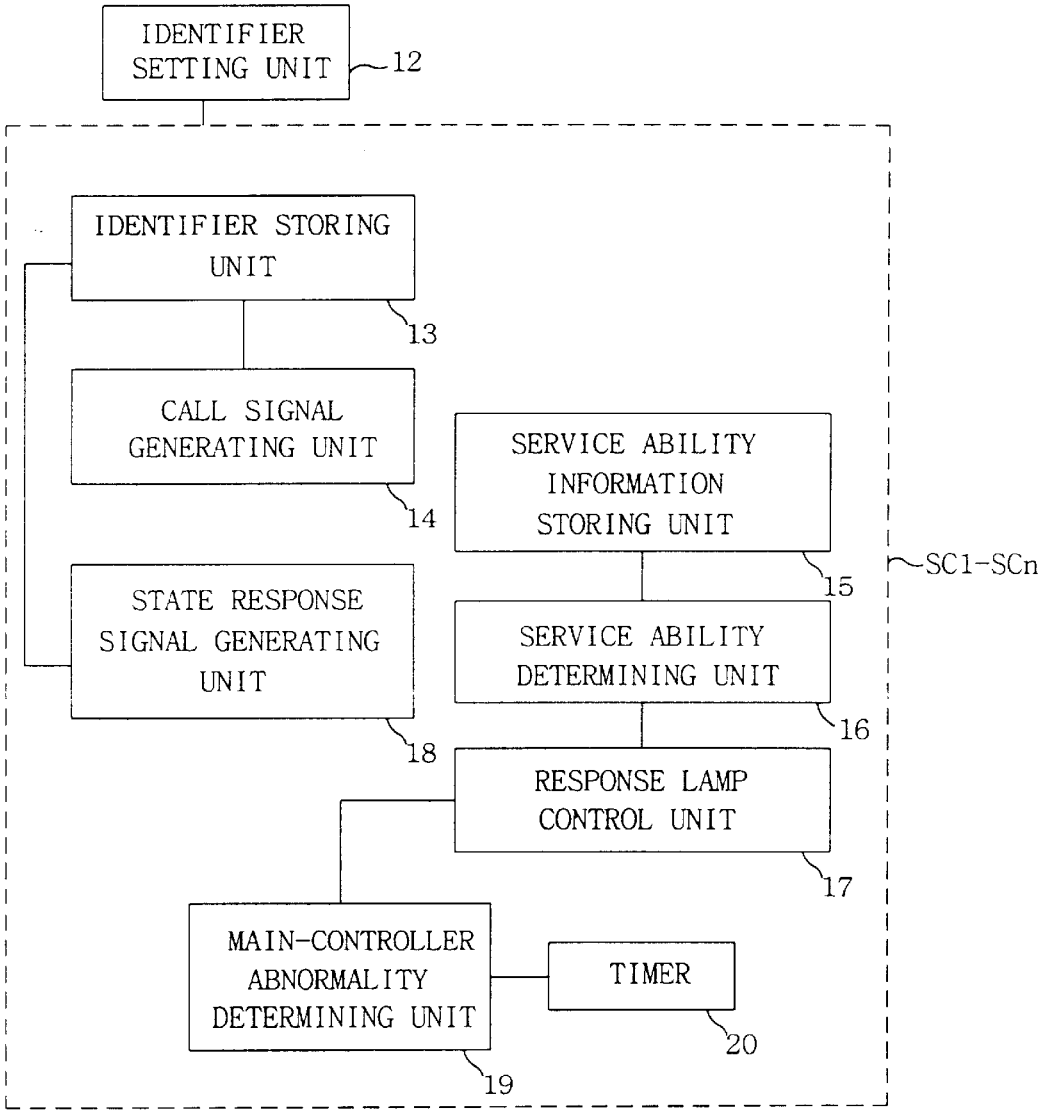
FIG. 7 is a block diagram illustrating sub-controllers in accordance with the third embodiment of the present invention.

FIG. 7 is a block diagram illustrating the sub-controllers in accordance with a third embodiment of the present invention. The sub-controllers SC1–SCn as shown in FIG. 7 further include a main controller abnormality determining unit determining abnormality of the main controller MC, in addition to the constitution of the sub-controllers SC1–SCn as shown in FIG. 6. The other components are identical in constitution and operation to the embodiment as shown in FIG. 5 or 6.

The sub-controllers SC1–SCn in FIG. 7 includes a timer 20 in order to determine abnormality of the main controller MC. The timer 20 is connected to a signal receiving unit (not shown) of the sub-controllers SC1–SCn. When a signal which is periodically transmitted by the main controller MC, for instance the state response instruction signal SRIS is not received until a predetermined time lapses, the timer 20 outputs an output signal indicating this. Whenever receiving the signal from the main controller MC, the timer resets a time which has lapsed.

When receiving a signal from the timer 20, the main controller abnormality determining unit 19 determines that the main controller MC is abnormal, and outputs a direction signal of turning off the response lamp UL or DL to the response lamp control unit 17 in order to inform the passengers at the hall that the elevator car is not able to provide a service. To the contrary, if a signal is not received from the timer 20, the main controller abnormality determining unit 19 determines that the main controller MC is normal.

Figure 8:
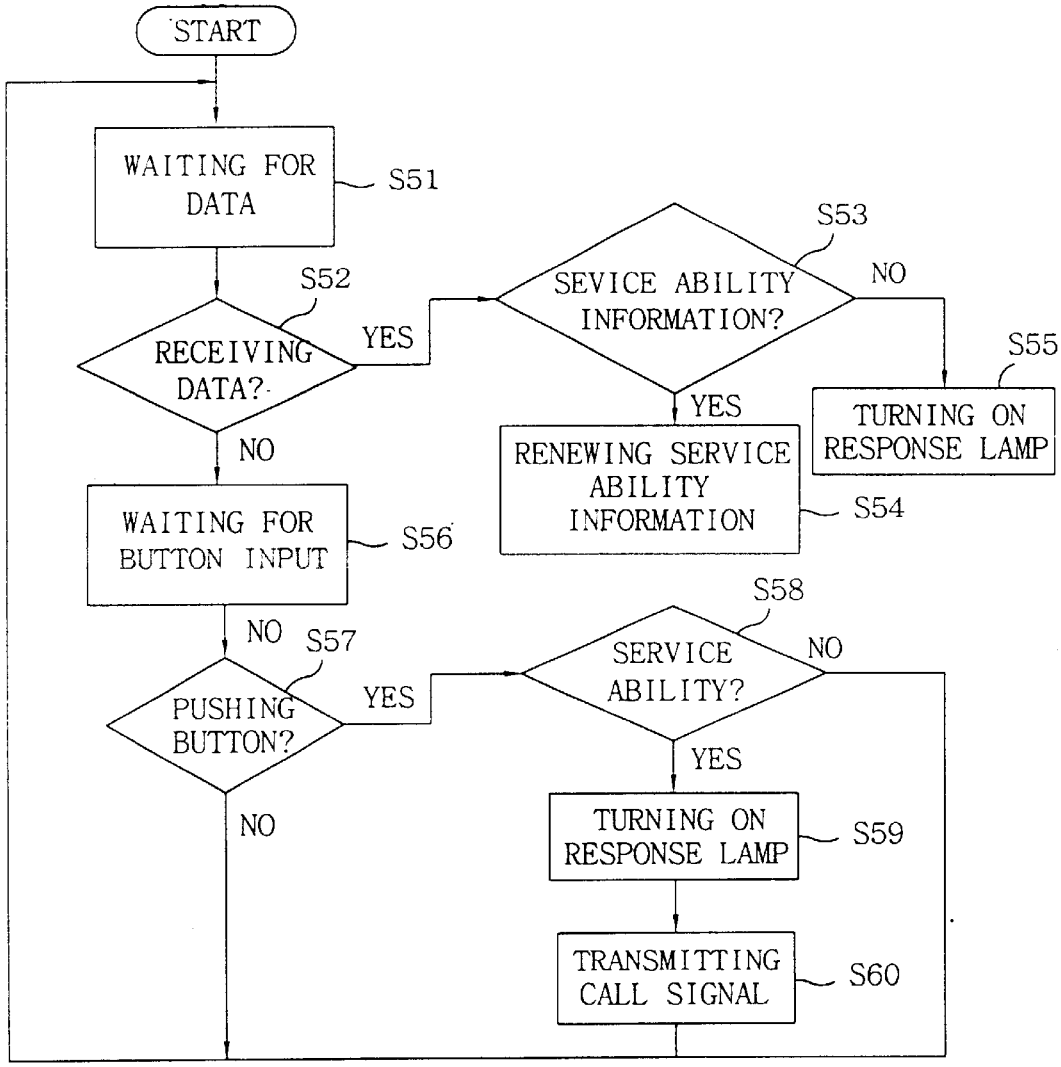
FIG. 8 is a flowchart showing a main control algorithm of the sub-controllers in accordance with the present invention.

On the other hand, the main control operation of the sub-controllers in accordance with the present invention will now be explained with reference to FIG. 8. FIG. 8 is a flowchart showing a main control algorithm of the sub-controllers in accordance with the present invention. A step S51 is a step of waiting for receiving a data from the main controller MC. In case the sub-controllers SC1–SCn receive the signal in a step S52, whether the received signal is the service ability information signal SAS is determined in a step S53. When the received signal is the service ability information signal SAS, the information data stored in the service ability information storing unit 15 is updated in a step S54. To the contrary, when the received signal is not the service ability information signal SAS, the sub-controllers SC1–SCn determine that the received signal is the ON or OFF direction signal of the response lamp, and proceed to a step S55. Here, the response lamp control unit 17 turns on or off the response lamp UL or DL according to the instruction signal.

On the other hand, in case the sub-controllers SC1–SCn do not receive any signal in the step S52, it proceeds to a step S56, and waits for input from call button input UB or DB. A step S57 is a step of determining whether the call button UB or DB is pushed. When the call button UB or DB is pushed, it proceeds to a step S58. If the call button UB or DB is not pushed, it returns to the step S51 of waiting for receiving the signal.

The service ability determining unit 16 determines service ability according to the information data stored in the service ability information storing unit 15 in the step S58. In case it is determined that the service can be provided in the step S58, it proceeds to a step S59, and thus the service ability determining unit 16 outputs the ON instruction signal to the response lamp control unit 17. Accordingly, the response lamp control unit 17 turns on the response lamp UL or DL.

Thereafter, it proceeds to a step S60, and thus the call signal generating unit 14 generates a call signal, and transmits it with an identifier to the main controller MC. If it is determined that the service cannot be provided in the step S58, it returns to the step S51 of waiting for receiving the signal.

Figure 9:
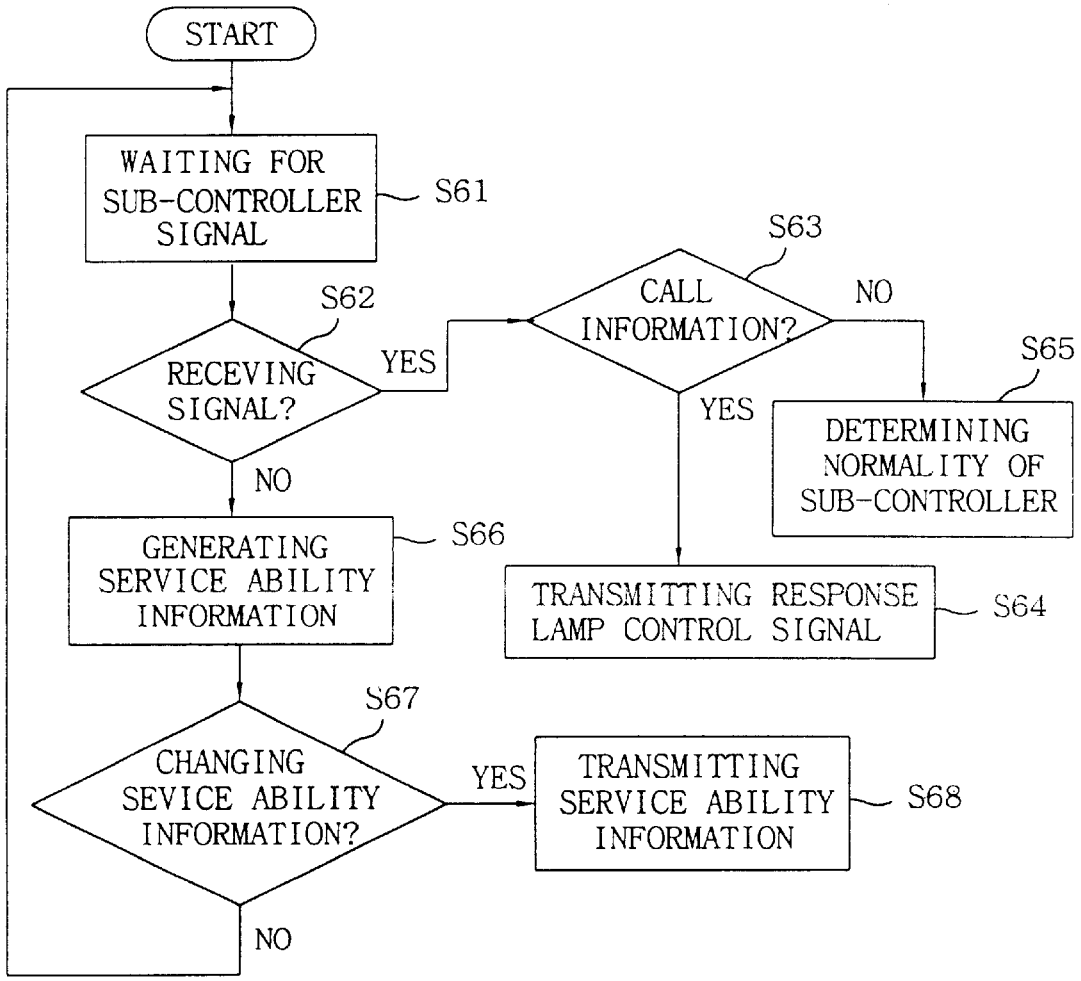
FIG. 9 is a flowchart showing a main control algorithm of the main controller in accordance with the present invention.

The main control operation of the main controller in accordance with the present invention will now be described with reference to FIG. 9. FIG. 9 is a flowchart showing a main control algorithm of the main controller in accordance with the present invention. A step S61 is a step of waiting for receiving a signal from the sub-controllers SC1–SCn. A step S62 is a step of determining whether a signal is received from the sub-controllers SC1–SCn. When the signal is received, it proceeds to a step S63. If the signal is not received, it proceeds to a step S66.

In the step S63, it is determined whether the received signal is a call signal from the hall. When the received signal is the call signal, it proceeds to a step S64. If the received signal is not the call signal, it proceeds to a step S65.

In the step 64, when the information signal indicating that the service can be provided is received from the operation control unit 1, the response lamp control signal generating unit 4 transmits the instruction signal of turning on the response lamp UL or DL to the sub-controllers SC1–SCn. To the contrary, when the signal indicating that the service cannot be provided is received from the operation control unit 1, the response lamp control signal generating unit 4 does not transmit the ON instruction signal of the response lamp. In the step S63, if the received signal is not the call signal, in the step S65, the main controller MC judges that the received signal is the state response signal SRS from the sub-controllers SC1–SCn, and also determines that the corresponding sub-controller SC1–SCn is normal.

In the step S62, in case a signal is not received, in the step 66, the service ability information signal generating unit 2 receives the information signal regarding the current service ability which is generated and outputted by the operation control unit 1. Thereafter, it proceeds to a step S67. Here, the service ability information signal generating unit 2 compares the information signal regarding service ability received from the operation control unit 1 with the previous information stored in the previous service ability information storing unit 3, and determines whether a change occurs. In the step S67, if a change occurs, it proceeds to a step S68. In case anything has been changed, it returns to the step S61, and waits for receiving the signal.

In the step S68, the service ability information signal generating unit 2 transmits the varied service ability information signal SAS to the sub-controllers SC1–SCn via the serial communication line SL.

Figures 10, 11, 12:
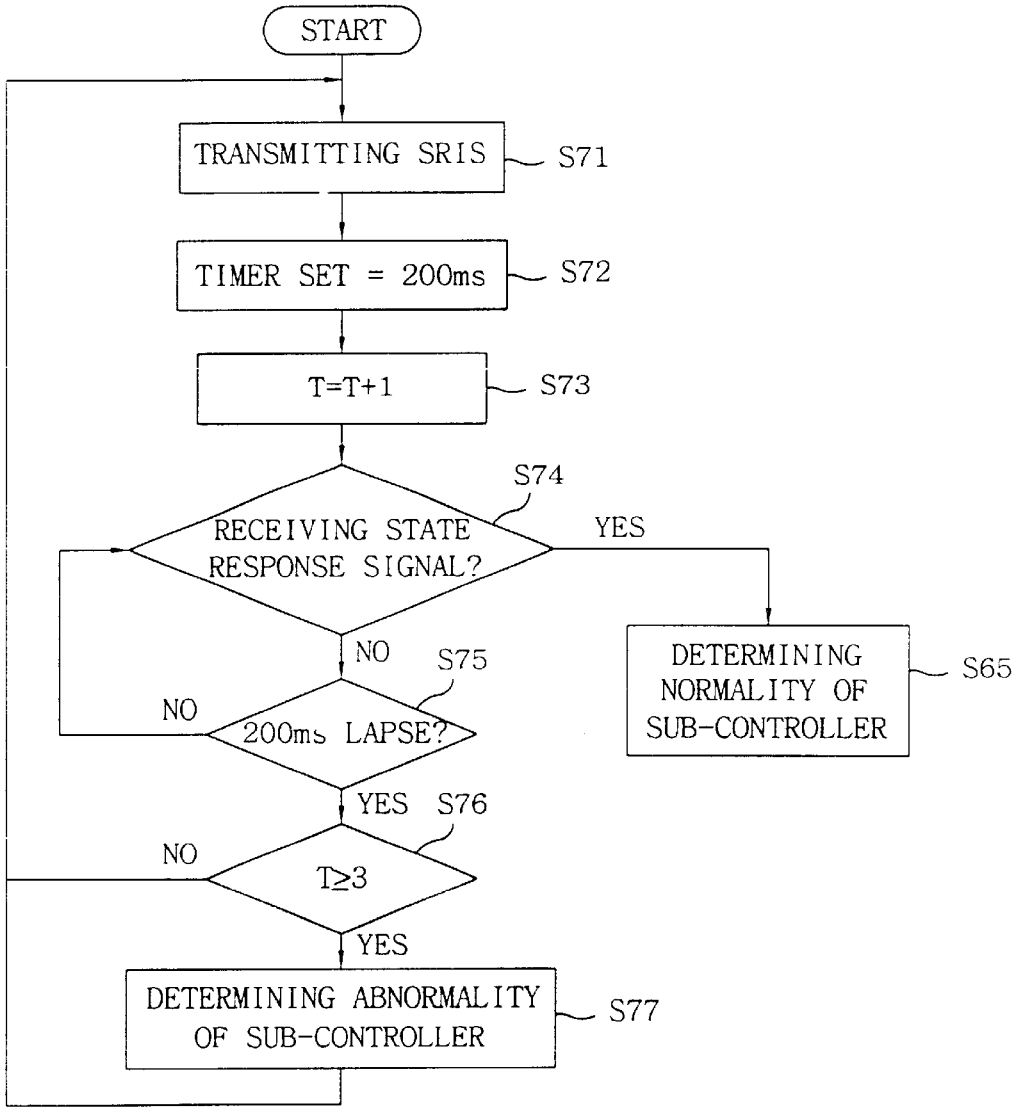
FIG. 10 is a flowchart showing an abnormality determination algorithm of the sub-controllers by the main controller in accordance with the present invention.
FIG. 11 illustrates a format of the data which the main controller transmits to the sub-controllers in accordance with the present invention.
FIG. 12 illustrates a format of the data which the sub-controllers transmit to the main controller in accordance with the present invention.

The sub-controller abnormality determining operation of the main controller in accordance with the present invention will now be described in more detail with reference to FIG. 10. FIG. 10 is a flowchart showing the sub-controller abnormality determining operation of the main controller in accordance with the present invention.

A step S71 is a step for the main controller MC to transmit the state response direction signal SRIS to each sub-controller SC1–SCn with the identifier thereof in order to determine abnormality of the sub-controllers SC1–SCn. A step S72 is a step of setting on the timer 9 a responding time when the sub-controllers SC1–SCn are normal, after the state response instruction signal SRIS is transmitted to the sub-controllers SC1–SCn. For example, 200 milliseconds are set. A step S73 is a step for the counter 8 to count a number T of transmitting the state response instruction signal SRIS. Whenever it proceeds to the step S73, '1' is added to the existing count value T. A step S74 is a step of determining whether or not the state response signal SRS is received from the sub-controllers SC1–SCn, after transmitting the state response instruction signal SRIS. In case the state response signal SRS is received, it proceeds to the step S65. When the state response signal SRS is not received, it proceeds to a step S75.

In the step S65, as described in FIG. 9, the sub-controller abnormality determining unit 6 determines that the corresponding sub-controller SC1–SCn is normal. In the step S75, the sub-controller abnormality determining unit 4 checks whether 200 ms which has been set in the timer 9 lapses, and an output signal indicating this is received from the timer 9. If the time 200 ms does not lapse in the step S75, it returns to the step S74, and it is determined again whether the state response signal SRS is received from the sub-controllers SC1–SCn. When the time 200 ms which has been set on the timer 9 lapses in the step S75, it proceeds to a step S76. In the step S76, the sub-controller abnormality determining unit 4 checks whether a signal is received from the counter 8 outputting an output signal informing that the transmission number is over 3 times.

In the step S76, if the counter 8 outputs the output signal, it proceeds to a step S77, and thus the sub-controller abnormality determining unit 4 judges that the corresponding sub-controller is abnormal. When the counter 8 does not output the output signal, it returns to the step S71 in order to check abnormality of the sub-controllers SC1–SCn again.

FIG. 11 illustrates a format of the information signal which the main controller MC transmits to the sub-controllers SC1–SCn. The information signal includes a data block ID of each sub-controller identifier, a data block data indicating information to be transmitted to the sub-controller corresponding to the identifier, and a data block car position data indicating the current car position information which is common to the whole sub-controllers SC1–SCn. The data blocks as shown in FIG. 11 compose a data frame to be transmitted at a time. The data block data indicating the information to be transmitted to the sub-controllers may include the service ability information data, the response lamp control signal data or the state response instruction signal data.

FIG. 12 illustrates a format of the information signal which the sub-controllers SC1–SCn transmit to the main controller MC. The information signal includes a data block ID of an identifier of the transmitting sub-controller, and a data block data indicating the information to be transmitted. The data block data may include the call signal data or the state response signal data.

As discussed earlier, in accordance with the elevator system for controlling the response to the call of the present invention, each of the sub-controllers includes the unit of storing the information regarding service ability to the hall call, and a unit of determining service ability based on the information stored in the unit when the call is generated from the hall, regardless of the call response signal from the main controller.

As a result, the determination and display of service ability to the hall call can be rapidly exactly performed.

In addition, in accordance with the elevator system for controlling the response to the call of the present invention, the main controller includes a unit of checking and determining abnormality of the sub-controllers, and a unit of storing the identifier of the abnormal sub-controller. Since the data is not transmitted to the abnormal sub-controller, a data transmission amount may be decreased. Also, during the repair or replacement work of the abnormal sub-controller, an identifier thereof can be rapidly confirmed.

Moreover, in accordance with the elevator system for controlling the response to the call of the present invention, the sub-controller includes a unit of checking and determining abnormality of the main controller. When the main controller is abnormally operated, the response lamp is turned off. As a result, the passengers are informed of that the elevator car is not able to provide the service, and thus do not unnecessarily wait for the elevator car at the hall.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An elevator system for controlling a response to call, comprising:

a call button for calling an elevator car;

a response lamp for responding to the elevator call by the call button, and for displaying service availability of the elevator car;

a plurality of sub-controllers connected to the call button and the response lamp, for determining service availability of the elevator car responding to a call when the call is generated by the call button, and for controlling an ON/OFF operation of the response lamp depending on the service availability of said elevator car;

a main controller for providing varied information regarding service availability of the elevator car to the sub-controllers, wherein the main controller further includes a state response instruction signal generating unit for generating a state response instruction signal in order to detect abnormality of the sub-controllers, and for transmitting it to the sub-controllers, a first timer for setting a response period from the sub-controllers responding to the state response instruction signal, and for outputting an output signal representing an expiration of the response period when it lapses, a counter for counting a predetermined transmission number of the state response instruction signal, and for outputting an output signal when it counts up, and a sub-controller abnormality determining unit for determining abnormality of the sub-controllers depending on the output signal from the timer, the output signal from the counter and the state response signal from the sub-controllers, and wherein each of the sub-controllers further comprises a state response signal generating unit for outputting to the main controller a response signal representing that the sub-controller is normally operated, responding to the state response instruction signal; and a serial communication line for providing a communication line between the plurality of sub-controllers and the main controller.

2. The elevator system according to claim 1, wherein the main controller further comprises:

a second timer for setting a communication period for periodical transmission of the state response instruction signal, and for outputting an output signal representing said period transmission of the state response instruction signal in each period; and wherein the sub-controller further comprises a main controller abnormality determining unit for determining that the main controller is abnormal, when the periodical signal transmission is not performed by the main controller until the predetermined period lapses; and a third timer for setting a period in order to determine abnormality of the main controller, and for outputting an output signal representing an expiration of the predetermined period when it lapses.

3. The elevator system according to claim 1, wherein the main controller further comprises a unit for storing information regarding normality or abnormality of the sub controllers judged by the sub-controller abnormality determining unit.

4. An elevator system for controlling a response to call, comprising:

a call button for calling an elevator car;

a response lamp for responding to the elevator call by the call button, and for displaying service availability of the elevator car;

a plurality of sub-controllers connected to the call button and the response lamp, for determining service availability of the elevator car responding to a call when the call is generated by the call button, and for controlling an ON/OFF operation of the response lamp depending on the service availability of said elevator car;

a main controller for providing varied information regarding service availability of the elevator car to the sub-controllers; and a serial communication line for providing a communication line between the plurality of sub-controllers and the main controller.

5. The elevator system according to claim 4, wherein each of the sub-controllers comprises:

a call signal generating unit for transmitting to the main controller a call signal representing a cell when the call is generated by the call button; and wherein the main controller comprises a service availability information signal generating unit for providing varied information regarding service availability of the elevator car to the sub-controller, and wherein the sub-controller further comprises a service availability information storing unit for storing the varied information from the service availability information signal generating unit; and a service availability determining unit for determining service availability of the elevator car responding to the call signal depending on the information stored in the service availability information storing unit, and for controlling the ON/OFF operation of the response lamp.

6. The elevator system according to claim 4, wherein in order for the main controller to identify each sub-controller, an identifier setting unit for setting identifiers of the sub-controllers is connected to the sub-controllers, respectively; and wherein the main controller further comprises a sub-controller identifier storing unit for storing the identifiers of the sub-controllers.

* * * * *